United States Patent [19]

Grandis

[11] Patent Number: 4,617,685

[45] Date of Patent: Oct. 21, 1986

[54] ORNAMENTAL BELT

[75] Inventor: Stanley Grandis, Forest Hills, N.Y.

[73] Assignee: S. G. D' or Industries, Inc., Long Island City, N.Y.

[21] Appl. No.: 721,337

[22] Filed: Apr. 8, 1985

[51] Int. Cl.[4] ..... A41F 9/02

[52] U.S. Cl. ..... 2/338; 2/339

[58] Field of Search ..... 2/338, 339, 311, 312, 2/321, 314, 319

[56] References Cited

U.S. PATENT DOCUMENTS 199,240 1/1878 Vinton et al. ..... 2/339 X 784,891 3/1905 Saart ..... 2/339 X 4,447,913 5/1984 Engelson ..... 2/338

*Primary Examiner*—Werner H. Schroeder

*Assistant Examiner*—J. L. Olds

*Attorney, Agent, or Firm*—Paul J. Sutton

[57] ABSTRACT

An ornamental elasticized fabric belt is featured having a number of ornamental discs or medallions arranged in seriatim about the band. The medallions overlap each other giving a unique and expensive appearance to the belt. As the belt is caused to expand, the medallions are caused to move with respect to each other, thus changing the appearance of the ornamentation.

4 Claims, 5 Drawing Figures

ORNAMENTAL BELT

FIELD OF THE INVENTION

The invention relates to wearing apparel and more particularly to a belt that is worn about the waist.

BACKGROUND OF THE INVENTION

Most expandable belts are made using elasticized fabric. Such belts are generally worn with slacks, shorts and casual wear, and are considered a low-cost item.

The present invention comprises an expandable belt that can be worn with more formal apparel, such as pants and dresses. The invention features an expandable belt having ornamentation disposed about the elasticized band so as to give an expensive appearance.

The ornamentation consists of a number of discs having a stylized fabric covering its outer surface. Each disc is disposed about the fabric band in seriatim. The discs appear over the band surface as overlapping medallions, and thus provide a very stylized and rich appearance.

Thus, a normally inexpensive elastic band is upgraded to a fashionable expensive-looking belt.

The discs may also be provided with semi-precious jewels and other ornamentation as befits the wearing purpose.

BRIEF SUMMARY OF THE INVENTION

The invention pertains to an ornamental belt which is worn about the waist. The belt comprises an elongated elasticized fabric band that is expandable from an unexpanded position to a fully expanded position in order to accommodate different waist sizes.

A plurality of disc-like ornaments are disposed about the fabric band in seriatim. Each ornament has a curved outer surface and a substantially flat inner surface. The ornaments each overlap, and each in turn overlapped, by adjacent ornaments when the band is in the unexpanded position. The ornaments lie substantially flat upon the band in a spaced-apart relationship with respect to each other when the band is in the fully expanded position.

A pair of tabs are disposed on the flat inner surface of each ornament. The tabs hook over the opposite edges of the elasticized band, whereby the ornament is affixed to the band.

A buckle device for buckling the band about the waist comprises a male and female clasp element. The male clasp element is affixed to one distal end of the band and the female clasp element to the opposite distal end. The male and female elements engage with each other to buckle the band about the waist.

The male and female clasp elements are disposed behind respective ornaments to hide them from sight upon buckling.

The outer curved surface of each ornament is covered by fabric.

The male clasp element comprises a hook-like finger, and the female clasp element has a slot for receiving the finger in buckling engagement.

It is an object of this invention to provide an expandable elasticized band having ornamentation thereabout to improve the appearance thereof.

It is another object of the invention to provide an improved elasticized band to be worn about the waist, which is expandable to fit different waist sizes.

These and other objects of this invention will be better understood and will become more apparent with reference to the subsequent detailed description considered in conjunction with the accompanying drawings.

DETAILED DESCRIPTION OF THE INVENTION

Generally speaking, the invention pertains to an ornamental belt comprising an expandable elasticized fabric band having a plurality or ornamental discs affixed thereto in seriatim.

Figure 1:
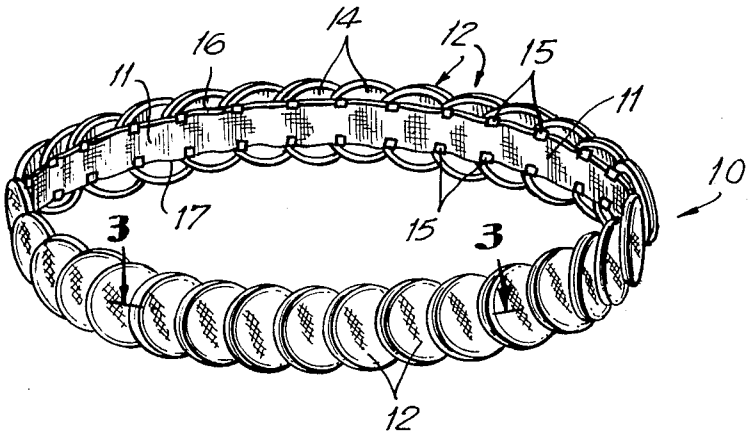
FIG. 1 is a perspective view of the ornamental belt of this invention in an unexpanded position.

Referring to FIG. 1, the ornamental belt 10 of this invention is shown in perspective view in a clasped, but unexpanded position.

For the purposes of brevity, like elements will have like designation throughout the description of the figures.

Figure 2:
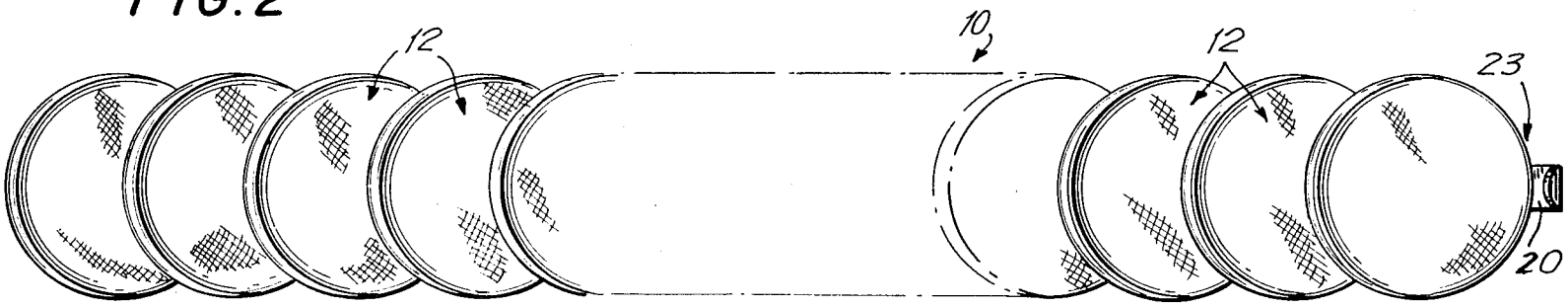
FIG. 2 is a partial plan view of the ornamental belt shown in FIG. 1.

The belt 10 comprises an elasticized fabric band 11. On the outside of the band 11 are disposed a plurality of disc-like medallions 12. The medallions 12 are arranged about band 11 in an overlapping pattern, shown in greater detail in FIG. 2.

Figure 3:
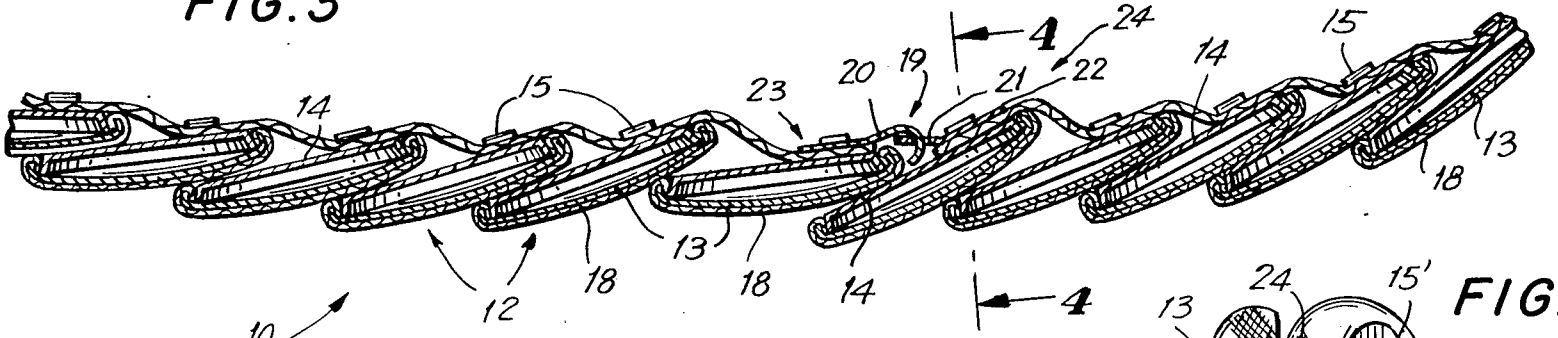
FIG. 3 is a sectional view taken along lines 3—3 of FIG. 1.

The medallions have a curved outer surface 13, illustrated in the sectional view of FIG. 3, and a flat inner surface 14.

The inner surface 14 of the medallions 12 have two tabs 15 disposed at the periphery thereof. The tabs 15 affixedly hook over the respective edges 16 and 17 of band 11, as best seen in FIG. 1. Tabs 15 anchor each medallion 12 to band 11, and as the band 11 is caused to stretch, medallions 12 will be caused to move with the band 11.

Figure 5:
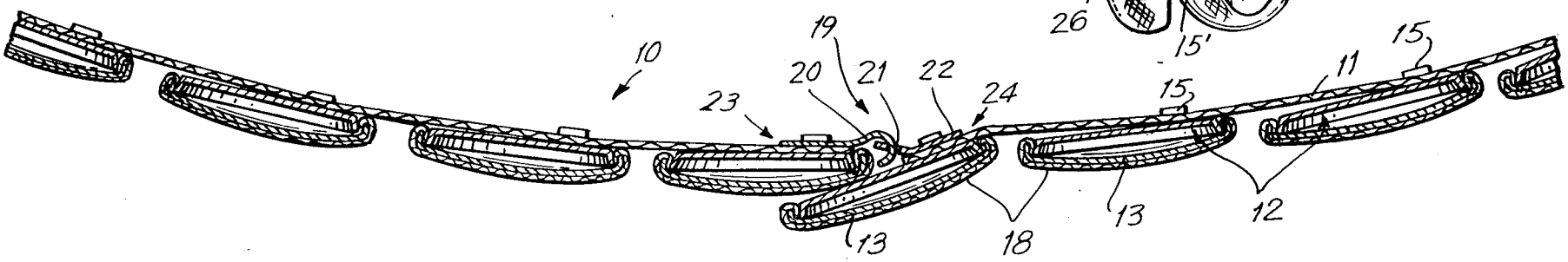
FIG. 5 is a sectional view of the ornamental belt of this invention in a fully expanded position.

In the fully expanded position shown in FIG. 5, the medallions 12 do not overlap, but rather are spaced-apart, as illustrated. Thus, the ornamental effect of the belt 10 will change accordingly with the amount the band 11 is stretched.

The stretching of hand 11 also allows for the fitting of the belt 10 to different waist sizes.

Figure 4:
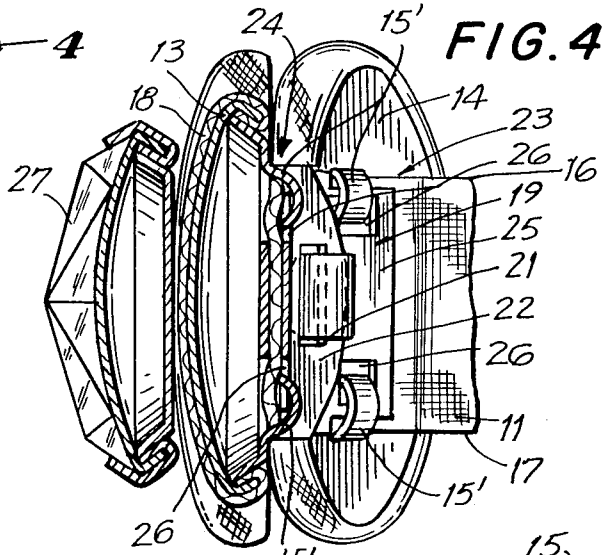
FIG. 4 is a sectional view of the buckle of the ornamental belt taken along lines 4—4 of FIG. 3.

A fabric 18 covers the outer curved surface 13 of each medallion 12, as illustrated in FIGS. 3–5. The fabric 18 adorns each medallion 12, and provides a rich and expensive appearance. As an alternative, or in addition thereto, to semi-precious jewel 27 may be attached to the medallion 12 as shown in FIG. 3.

The belt 10 is secured around the waist of the wearer by means of a buckle device 19 comprising a metal plate 25 having a hook-like finger 20, that is inserted into a slot 21 of an adjoining metal plate 22, best seen in FIG. 3.

The finger 20 is attached at one distal end 23 of the band 11, and the slotted metal plate 22 is attached to the opposite distal end 24 of band 11. The buckle plate elements 22 and 25 are each disposed behind a respective medallion 12 (FIG. 3). End Tabs 15' serve to anchor each plate 22 and 25, respectively to its medallion 12. These end tabs 15' project through slots 26 in respective plates 22 and 25, and bite into the band 11 disposed beneath the plates 22 and 25. In this way, the end tabs 15' serve two purposes: (1) anchor the medallion 12 to band 11; and (2) secure the buckle device 19 to the ends 23 and 24 of the band 11.

The medallions can be made of metal or plastic, and can be made solid or hollow.

The elasticized fabric band 11 can be made from material common in the trade.

Having thus described the invention, what is desired to be protected by Letters Patent is presented in the subsequently appended claims.

What is claimed is:

1. An ornamental belt to be worn about the waist, comprising an elongated elasticized fabric band that is expandable from an unexpanded position to a fully explanded position, in order to accommodate different waist sizes; a plurality of disc-like ornaments disposed about said fabric band in seriatim, each ornament having a curved outer surface and a substantially flat inner surface, said ornaments each overlapping, and being overlapped by adjacent ornaments when said band is in said unexpanded position, said ornaments lying flat upon said band in a spaced-apart relationship with respect to each other when said band is in said fully expanded position;

a pair of tabs disposed on said flat inner surface of each ornament, each pair of tabs hooking over opposite edges of said elasticized fabric band and providing that each ornament be contiguously affixed to said band in a flat spaced-apart relationship with respect to each other in said fully expanded position; and a buckle device for buckling said band about said waist, comprising male and female clasp elements, said male clasp element affixed to one distal end of said band and said female clasp element affixed to an opposite distal end of said band, said male and female clasp elements engaging with each other to buckle said band about said waist.

2. The ornamental belt of claim 1, wherein said male and said female clasp elements are each disposed behind respective ornaments affixed at said distal ends of said band.

3. The ornamental belt of claim 1, wherein each ornament is covered by fabric over its respective curved outer surface.

4. The ornamental belt of claim 1, whererin said male clasp element comprises a hook-like finger, and said female clasp element has a slot for receiving said finger in buckling engagement.

* * * * *